United States Patent [19]

Khan

[11] Patent Number: 4,565,125

[45] Date of Patent: Jan. 21, 1986

[54] RAM AND FRAMELESS CABINET ASSEMBLY FOR COMPACTOR

[75] Inventor: Aman U. Khan, Lincoln Township, Berrien County, Mich.

[73] Assignee: Whirlpool Corporation, Benton Harbor, Mich.

[21] Appl. No.: 620,760

[22] Filed: Jun. 14, 1984

[51] Int. Cl.[4] ..... B30B 15/04

[52] U.S. Cl. ..... 100/214; 100/229 A; 100/245; 308/3 R

[58] Field of Search ..... 100/229 A, 290, 214, 100/240, 245; 308/3 R, 3 A, 3 B, 3.6; 312/350

[56] References Cited

U.S. PATENT DOCUMENTS 1,306,373 6/1919 Emerson .
3,602,136 8/1971 Lath .
3,613,560 10/1971 Bottas .
3,643,589 2/1972 Carter .
3,786,744 1/1974 Miller et al. .
3,839,954 10/1974 Bourgeois ..... 100/229 A
3,862,593 1/1975 Engebretsen .
4,279,198 7/1981 Johnson .

*Primary Examiner*—Billy J. Wilhite
*Attorney, Agent, or Firm*—Wood, Dalton, Phillips, Mason & Rowe

[57] ABSTRACT

According to the invention, elongate legs suspend a refuse engaging ram surface and guide reciprocative movement thereof between retracted and compacting positions. Adjustable pressure equalizing pads are spaced lengthwise on each of the legs and have flat contact areas for facial engagement with a guiding surface to effect distribution of forces transverse to the line of the ram compacting stroke over the guiding surface. The invention contemplates sufficient force distribution that the inside surface of a thin wall, typically forming the exposed shell of the compactor, is suitable as a sole ram guiding structure.

20 Claims, 6 Drawing Figures

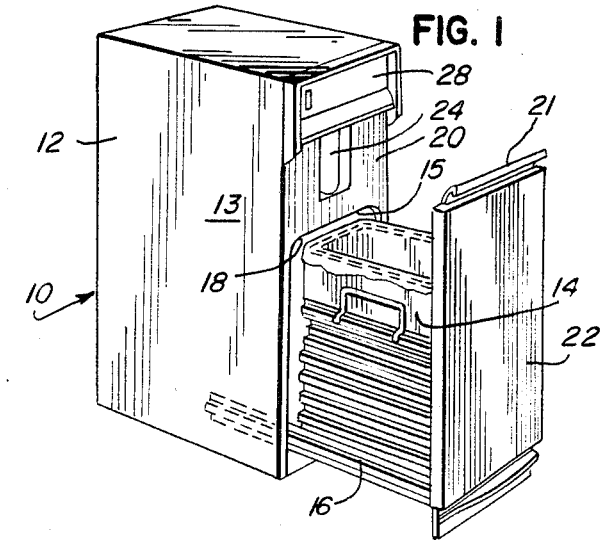
FIG. 1
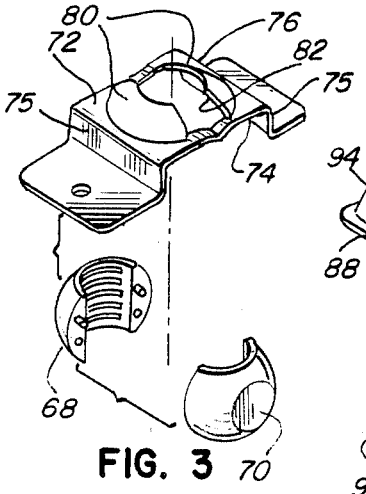
FIG. 3
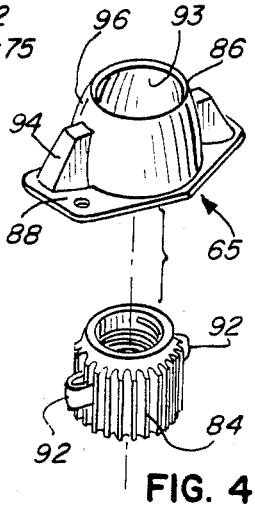
FIG. 4
FIG. 2
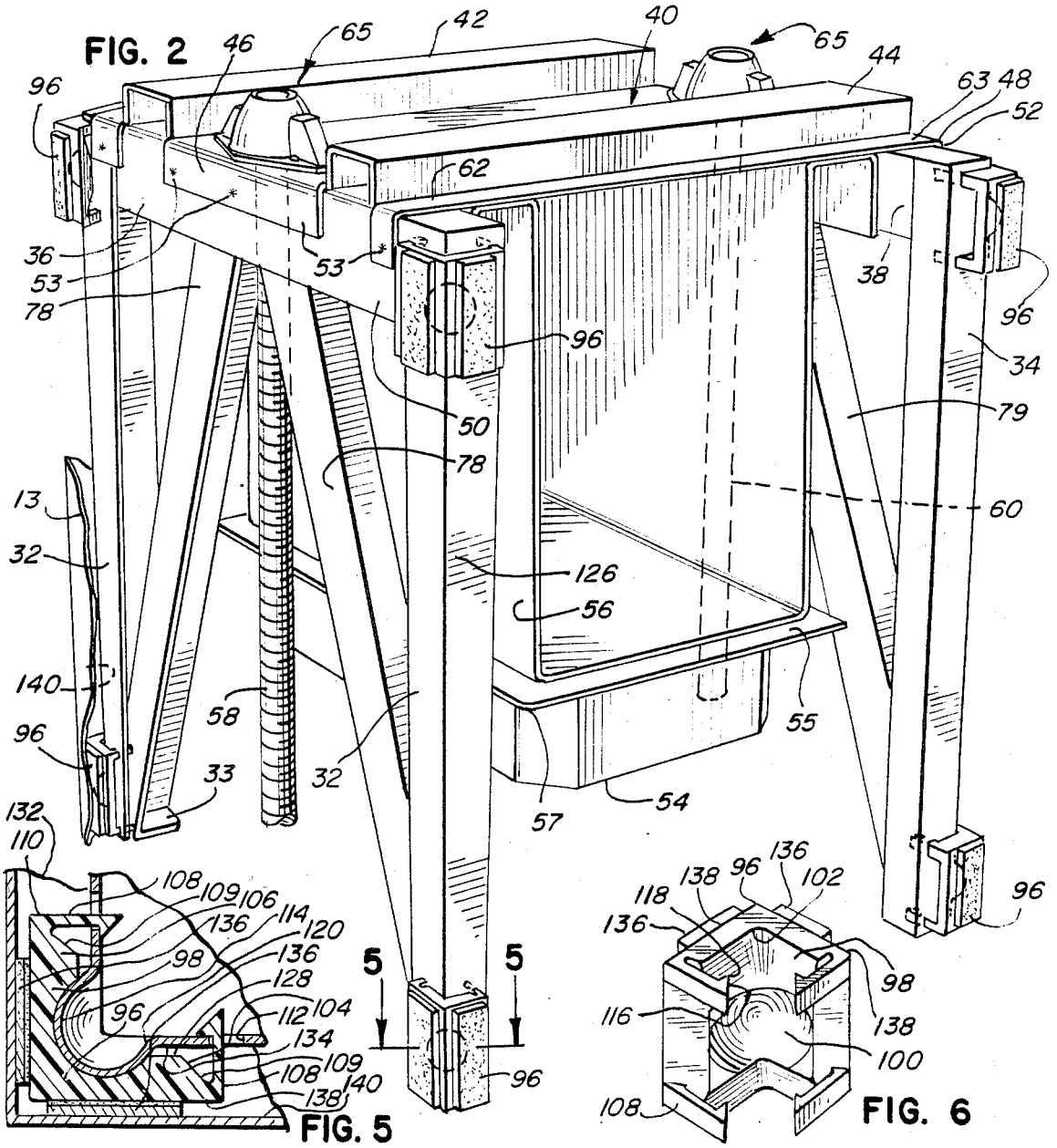
FIG. 5
FIG. 6

RAM AND FRAMELESS CABINET ASSEMBLY FOR COMPACTOR

BACKGROUND OF THE INVENTION

1. Field of the Invention

This invention relates to refuse compactors and, more particularly, to ram assemblies for use therein.

2. Background Art

In conventional refuse compactors, a ram is guidingly driven into a refuse disposal receptacle. Upon encountering unevenly distributed refuse, the ram tends to cant and/or twist and thereby exerts a substantial, undesirable transverse force on the ram guiding assembly during the ram stroke. Due to the potential magnitude of these transverse forces, prior compactor structures employed heavy structural iron guiding frames. U.S. Pat. No. 3,613,560 to Bottas illustrates such a structure.

The structural iron framework is generally skeletal in nature and an encasing sheet metal cabinet enclosure is normally further provided. The use of both an internal structural iron framework and an external cabinet enclosure increases the number of structural parts and cost, and complicates assembly.

The structural iron framework also presents the vexatious problem of obstructing access to the internal compactor works so that servicing of the refuse compactor is made more difficult.

One alternative to use of the structural iron guide framework is disclosed in U.S. Pat. No. 3,786,744, to Miller et al. Miller et al disclose a sheet metal guide column that is rigidified by providing inturned corners and embossments in the portion between the corners. While suitable as a guide structure and an improvement over the earlier iron-framed structures in terms of reduction in weight and materials, the guide assembly in Miller et al still requires the use of an undesirable internal guide structure in addition to an outer cabinet enclosure, and has a number of the drawbacks found in the Bottas structure.

SUMMARY OF THE INVENTION

The present invention comprehends an improved refuse compacting structure which eliminates the discussed deficiencies of the prior art in a novel and simple manner.

According to the invention, elongate ram legs guide reciprocative movement of a refuse compacting ram between retracted and compacting positions. Pressure equalizing pads are spaced lengthwise on each of the legs. The pads have flat contact areas for facial engagement with a guiding surface to effect distribution over the guiding surface of forces transverse to the line of the ram compacting stroke. The invention contemplates sufficient force distribution that the inside surface of a thin sheet metal member, typically forming the outer cabinet enclosure of the compactor, is suitable as a sole guide surface.

By eliminating the need for separate internal ram guide means, the construction of the compactor is much simplified and the costs attendant manufacture proportionately reduced without compromising the developed compaction force. By eliminating the internal guide means, access to the internal mechanism is unobstructed.

The desired distribution of the transverse forces is further enhanced by extending the spacing between the equalizing pads beyond the spacing of conventional slide bearings used in prior compactors.

By incorporating the structure of the present invention, the outer cabinet can be made from relatively light gauge metal without the risk of damage or deformation to the cabinet, while the cabinet serves simultaneously as a ram guide means and a protective decorative, exterior shell. Because of the effective distribution of transverse forces, the need for a tilt-ram switch and indicator are obviated. Further, the need for field servicing is substantially reduced.

BRIEF DESCRIPTION OF THE DRAWINGS

Other features and advantages of the invention will be apparent from the following description taken in connection with the accompanying drawings wherein:

FIG. 1 is a perspective view of a conventional type compactor to which the invention is adaptable;

FIG. 2 is a perspective view of a preferred form of ram assembly according to the present invention;

FIG. 3 is an exploded perspective view of a floating drive nut for the ram assembly in FIG. 2;

FIG. 4 is an exploded, perspective view of an alternative drive nut to that in FIG. 3;

FIG. 5 is a sectional view of a pressure equalizing pad according to the present invention taken along line 5—5 of FIG. 2; and FIG. 6 is a perspective view of the pressure equalizing pad of FIG. 4.

DESCRIPTION OF THE PREFERRED EMBODIMENT

A conventional type refuse compactor, to which the present invention is adaptable, is illustrated in FIG. 1 at 10. The compactor 10 comprises a generally rectangular cabinet 12 with an exposed outer surface defined by a sheet metal wall 13 which encloses a compacting chamber 15. A refuse disposal receptacle 14 is translatable along guide rails 16 in drawer-like fashion through an opening 18 in the front wall 20 of the cabinet 12 to situate the receptacle 14 selectively in either the FIG. 1 position for accepting refuse or within the compacting chamber 15. The bin 14 is integral with and manually controlled through a handle 21 on a front drawer panel 22. A container 24 of deodorizing fluid is provided in a recess 26 in the front wall 20 of the cabinet and may be set up to automatically discharge in response to movement of the bin. A control panel 28 is mounted on the upper portion of the front wall to operate the compactor.

A ram assembly embodying the present invention is depicted in FIG. 2. The ram assembly comprises a frame with a first pair of upright legs 32 spaced laterally from a second pair of legs 34 (only one shown). Rubber pads 33 are provided at the bottom ends of the legs and abut the base of the compactor (not shown) to interrupt the ram stroke in a no-load condition. The first pair of legs 32 is rigidly inter-connected by a beam 36 and the second pair of legs 34 in like manner is joined by beam 38.

The beams 36, 38 are spanned laterally by a metal ram top member 40 which has two, integral, preformed downwardly opening channels 42, 44, which rigidify the top member. The top member 40 has depending flanges 46, 48 interrupted in the vicinity of the channels and closely facially abutting the laterally oppositely facing surfaces 50, 52 of beams 36, 38 respectively. The flanges are secured to the beams as by spot welds 53.

A ram cover 54 with a refuse engaging surface is suspended beneath the ram top member 40 by a housing 56 and situated near the bottom of legs 32, 34 to maximize the effective length of the compacting stroke. A resilient ram wiper 55 is captured between the housing 56 and ram cover 54 and has a peripheral edge 57 which conforms to the internal refuse receptacle (not shown) to scrape refuse from the receptacle during movement of the ram and prevent accumulation of refuse on the receptacle walls. The ram assembly is forcibly driven by means of a conventional electric motor and drive assembly (not shown), associated with the base of the compactor. The ram assembly is coupled to the drive assembly through a suitable connection which includes vertical power screws 58, 60.

The lower end of each power screw is journalled in a suitable conventional bearing (not shown) at the base of the compactor. The power screws 58, 60 each threadably couple with a floating drive nut assembly 64 fixed against the upper surface portions 62, 63 of ram top member 40. One suitable drive nut assembly is detailed in FIG. 3.

Each nut assembly 64 comprises mating hemispherical nut halves 68, 70. The mated halves 68, 70 are captured together against the upper surfaces of the member 40 by a housing 72 having a downwardly opening channel 74 with legs 75 terminating in outturned flanges which are used to anchor the housing with the surface portions 62, 63.

The channel 74 has a web 76 defining an upwardly convex surface 80 with an elongate slot 82 extending lengthwise of the web 76. The captured nut defined by halves 68, 70 seats and is pivotable, but not rotatable, within the surface 80 of the web. The slot 82 accommodates shifting of the power screws 58, 60 as the ram tilts forwardly or rearwardly about the axes of the screws 58, 60 upon encountering an off-center load.

An alternative to the drive nut assembly 64 in FIG. 3 is illustrated at 65 in FIG. 4, and shown as assembled with the ram assembly in FIG. 2. In FIG. 4 a threaded, one-piece, vertically ribbed nylon drive nut 84 is captured in place on the ram assembly by a housing 86. The housing 86 comprises a flange 88 integral with a truncated, upwardly convex body 90, which encases the nylon nut 84. The nut has a pair of diametrically oppositely extending ears 92 which are loosely accepted in projections 94 associated with the body 90. The opening 93 in the housing is sufficiently large to accommodate shifting of the ram forwardly and rearwardly as with the prior assembly 64.

Cross-braces 78, 79 are fixed between the leg pairs 32, 34 and their respective connecting beams 36, 38 to resist forces incident to the forward and rearward tilting of the ram assembly. Side-to-side tilting of the ram assembly, on the other hand, does not occur. The power screws 58, 60 are advanced at the same rate which precludes such side-to-side tilting and, therefore, obviates the need for lateral bracing.

In operation, the drive means (not shown) forcibly reciprocate the ram assembly into and out of the refuse receptacle 14. Upon encountering an off-center load, the ram surface 54 may cant or twist which exerts a force transverse to the line of the ram stroke. It is the objective of the present invention to distribute these twisting and tilting forces in such a manner that they can be withstood by a thin sheet metal wall without damage or deformation.

To accomplish the desired force distribution, a plurality of pressure equalizing pads 96, shown in FIGS. 2, 5 and 6, are provided on each of the legs 32, 34. These pads reside in the clearance between the inner surface of wall 13 and the ram assembly, and center the ram assembly in the cabinet 12. Each pad 96 comprises a rigid, nylon, L-shaped base member 98 having an internally formed cup-shaped socket 100 opening away from the inside corner 102 of the L at the juncture of planar leg portions 104, 106. A plurality of integral, resilient fingers 108 project from the free edge of the planar leg portions 104, 106 and substantially perpendicularly thereto. The free edges 109 of the leg portions 104, 106 taper to define a flexible, bendable hinge portion 110 for each finger 108.

To floatingly mount the pads 96 to the ram legs 32, 34, the ram legs are provided with a corresponding number of apertures 112, in alignment with the fingers 108, which number four in the disclosed embodiment. A spherical protuberance 114 on each of the legs 32, 34 is accepted in the socket 100 to make a ball-and-socket connection. Alternatively, protruberances could be provided on the pads to cooperate with sockets on the legs. The connection is maintained by extending the fingers 108 into the apertures for snap-type engagement.

Each finger 108 has a guiding ramp surface 116 which deflects the finger sufficiently to clear the widest portion 115 of the finger and seat a shoulder 118 defined at the trailing end of surface 116 behind the inside wall 120 of each leg 32, 34. At the instant that the shoulder 118 clears the inside ram leg surface 120, the resilient nature of the finger urges the shoulder 118 into seating engagement. The ramp surfaces 116 on opposite fingers 108 of each pad 96 face each other so that simultaneous seating of the fingers can be accomplished by simply advancing the inside corner 102 of each pad 96 toward the outside corner 126 of the legs 32,34.

To allow for floating movement of the pad relative to the legs 32, 34, the dimensions of the socket 100 and protuberance 114 are chosen so that the inside facing walls 128, 130 of planar leg portions 104, 106 of the pads 96 are spaced from the outside walls 132, 134 of the legs 32, 34, with the protuberance 114 bottomed in the socket 100. Limited universal pivoting of the protuberance in the socket is thus possible.

A felt pad 136 is glued on each of the outwardly facing perpendicular faces 138 of the pad 96. The felt is sufficiently thick to deform and flatten against the inside surface of the sheet metal wall 13 even though the faces 138 may not be perfectly parallel as when the ram assembly shifts upon encountering a load during compaction. This enlarges the area of intimate contact between the pads and sheet metal wall for more effective force distribution. The felt also minimizes noise caused by the shifting ram assembly. The pads 96 are assembled adjacent the upper and lower extremities of each leg 32, 34 to align the pads substantially parallel with the inside surface 140 of the outer sheet metal cabinet wall 13.

Due to manufacturing tolerances, not all the felt surfaces on the load equalizing pads contact the inner cabinet surface at any given point in time though the pads effectively restrict unwanted movement of the ram assembly in the cabinet 12. Upon encountering a load within the refuse receptacle, the descending ram may tilt, twist or otherwise shift so that at least a plurality of the load equalizing pads contact the surface 140 and transmit the non-vertical forces to the wall 13. These forces are reduced by reason of the substantial vertical spacing of the pads and the large surface area of each pad which engages the wall surface 140. By way of example, the vertical spacing between the points of contact between the pads 96 and the wall surface 140 is on the order of about 17 inches. Conventional slide bearings in the prior art refuse compactors have been spaced generally no further than about 5 inches.

The ball-and-socket mount for the pads, permits each pad to assume a facial alignment with the inside wall of the cabinet. The felt deforms and cooperates with the floating movement to assure that substantially the entire exposed area of the felt pad is brought into intimate engagement with the inside surface of the cabinet.

The foregoing disclosure is illustrative of the broad inventive concepts comprehended by this invention.

Having described the invention, the embodiments of the invention in which an exclusive property or privilege is claimed are defined as follows:

1. In a refuse compacting apparatus having an exposed sheet metal wall having an inside surface, an inner refuse receptacle, a vertically reciprocable ram assembly having a plurality of vertically extending legs, and means for forcibly driving the ram assembly along a preselected path to effect refuse compaction in the receptacle, the improvement comprising:

a plurality of pressure equalizing pads, each said equalizing pad having a substantially flat surface; and mounting means for floatingly mounting said pressure equalizing pads to said vertically extending legs, said mounting means allowing repositioning of the equalizing pads relative to the legs so that the flat surface of each of a plurality of the pressure equalizing pads facially engages said inside surface of the exposed sheet metal wall in the event that the ram assembly deviates from said preselected path during a compaction operation, said pressure equalizing pads being arranged to cause transverse forces produced by the ram to be distributed over said inside surface suitably so that said inside surface can serve as the sole guide means for the ram assembly without damage to the sheet metal wall.

2. An improved refuse compacting apparatus according to claim 1 wherein a compressible layer is mounted on the flat surface of each of the equalizing pads, said layer cooperating with the mounting means to ensure that a substantial intimate contact area is defined between the pressure equalizing pads and the inside surface of the sheet metal wall for effective force distribution.

3. An improved refuse compacting apparatus according to claim 1 wherein said mounting means comprise cooperating, rounded protuberances and sockets on said legs and pressure equalizing pads and a plurality of resilient fingers on each of the pressure equalizing pads snap fit into apertures in said legs to maintain the rounded protuberances floatingly in the sockets.

4. In a refuse compacting apparatus having an outer sheet metal cabinet defining an inside surface which defines a plurality of vertically extending corners, an inner refuse receptacle, a vertically reciprocable ram assembly having a plurality of vertically extending legs and means for selectively, forcibly advancing the ram assembly into said receptacle toward the bottom of the cabinet in a preselected path to effect compaction of the refuse, the improvement comprising:

a plurality of L-shaped pressure equalizing pads on each of said vertically extending legs, each equalizing pad having flat, transverse surfaces; and means for floatingly mounting said pressure equalizing pads to said legs, said pressure equalizing pads being aligned in the corners of said inside cabinet surface for guiding vertical reciprocable ram movement within said cabinet, said mounting means allowing repositioning of the equalizing pads relative to the legs so that the flat surfaces on a plurality of the pressure equalizing pads facially engage said inside cabinet surface adjacent the said corners in the event that the ram deviates from the preselected path as the ram assembly is advancing toward the bottom of the cabinet, said pressure equalizing pads effecting distribution of non-vertical forces from said ram assembly to said inside cabinet surface in such a manner that said inside cabinet surface can serve as a sole guide means for said ram assembly without damage to said sheet metal surface.

5. An improved refuse compacting apparatus according to claim 4 wherein said mounting means comprise cooperating, rounded protuberances and sockets on said legs and pressure equalizing pads and means for snap fastening said legs and pressure equalizing pads to each other to maintain the rounded protuberances floatingly in the sockets.

6. An improved refuse compacting apparatus according to claim 4 wherein a layer of compressible material is fixed on the transverse, flat surfaces of each of said equalizing pads, said layer cooperating with said mounting means to ensure that substantially the full area of said pad surface contacts said inside cabinet surface when non-vertical forces are being transmitted from said ram assembly to said cabinet.

7. An improved refuse compacting apparatus according to claim 4 wherein said mounting means includes a plurality of flexible fingers integrally formed with said L-shaped pressure equalizing pads, each said flexible leg snap fitting into an aperture in one of said vertically extending legs.

8. An improved refuse compacting apparatus according to claim 4 wherein a first and second of the pressure equalizing pads on at least one of said legs are spaced apart by a distance of more than 10 inches.

9. An improved refuse compacting apparatus according to claim 4 wherein said outer sheet metal cabinet is formed of cold rolled steel and has a thickness within the range of 0.029 inches to 0.048 inches.

10. An improved refuse compacting apparatus according to claim 4 wherein said mounting means comprises a plurality of flexible fingers integrally formed with each of said L-shaped pressure equalizing pads, said vertically extending legs each having an inside wall surface and a plurality of apertures to accept said fingers and each of said fingers has a ramp surface and a shoulder adjacent said ramp surface, said ramp surface causing said fingers to deflect upon insertion of said fingers into said apertures, said shoulders seating behind said inside wall surfaces of the vertically extending legs with said pressure equalizing pads in a fullly seated position.

11. A ram assembly for a refuse compactor of the type having a cabinet with a sheet metal wall and an inside surface on the sheet metal wall for guiding vertical reciprocable movement of the ram assembly along a first line, said ram assembly comprising:

frame means for mounting a ram surface for directly contacting refuse during a compaction stroke;

a plurality of pressure equalizing pads, each said pad having a flat surface; and means for floatingly mounting the pressure equalizing pads at vertically spaced locations on the frame, said mounting means allowing repositioning of the equalizing pads relative to the frame so that the flat surfaces on a plurality of said pressure equalizing pads are substantially fully engageable with the inside surface of the sheet metal wall to distribute forces transverse to said first line over the inside surface of the sheet metal wall during the compaction stroke sufficiently that the inside surface can serve as the sole guide for the ram assembly without damage to the sheet metal wall.

12. A ram assembly according to claim 11 wherein said frame has a plurality of vertically extending legs defining four corners, said pressure equalizing pads are substantially L-shaped with transverse, flat surfaces and said mounting means connect the pressure equalizing pads at the corners of the legs.

13. A ram assembly according to claim 11 wherein a first and second of said pressure equalizing pads are vertically spaced by a distance which is greater than the width of said frame means.

14. A ram assembly according to claim 11 wherein a layer of resilient material is disposed over the flat surfaces of the pressure equalizing pads.

15. A ram assembly according to claim 11 wherein said pressure equalizing pads are made at least partially from a resilient plastic.

16. A ram assembly according to claim 11 wherein said mounting means comprise cooperating protuberances and sockets on the frame and pressure equalizing pads and means connecting between the frame and the pressure equalizing pads to maintain the protuberances in the sockets.

17. A ram assembly according to claim 11 wherein said cabinet defines four corners and said frame means includes four vertically extending legs, each of said legs defining a corner which nests within a respective cabinet corner and extends downwardly to a point below the level of said ram surface.

18. A ram assembly of claim 17 wherein each of said legs carries one of said pressure equalizing pads at its top and bottom portions.

19. An improved ram assembly according to claim 1 wherein with the flat surfaces of a first plurality of the pressure equalizing pads engaged with the inside surface, at least one of the legs bears rigidly against one of the pads in the first plurality of pads in transmitting forces therethrough.

20. The improved refuse compacting apparatus according to claim 11 wherein with the flat surfaces of a first plurality of the pressure equalizing pads engaged with the inside surface, the frame bears rigidly against the first plurality of pads in transmitting forces therethrough.

* * * * *